US008931457B2

(12) United States Patent
Petruska et al.

(10) Patent No.: US 8,931,457 B2
(45) Date of Patent: Jan. 13, 2015

(54) MULTIPLEXING DRIVE CIRCUIT FOR AN AC IGNITION SYSTEM WITH CURRENT MODE CONTROL AND FAULT TOLERANCE DETECTION

(75) Inventors: David C. Petruska, Fort Collins, CO (US); Doyle Kent Stewart, LaPorte, CO (US); Monte Lee Wegner, Bellvue, CO (US); Gerald Michael Eberhardt, Fort Collins, CO (US)

(73) Assignee: Woodward, Inc., Foot Collins, CO (US)

( * ) Notice: Subject to any disclaimer, the term of this patent is extended or adjusted under 35 U.S.C. 154(b) by 865 days.

(21) Appl. No.: 13/175,311

(22) Filed: Jul. 1, 2011

(65) Prior Publication Data

US 2011/0255208 A1 Oct. 20, 2011

Related U.S. Application Data

(63) Continuation-in-part of application No. 12/542,794, filed on Aug. 18, 2009, now Pat. No. 8,276,564.

(51) Int. Cl.

| | |
|---|---|
| ***F02P 5/00*** | (2006.01) |
| ***F23Q 3/00*** | (2006.01) |
| ***F02P 3/01*** | (2006.01) |
| ***F02P 15/02*** | (2006.01) |

(52) U.S. Cl.
CPC .. *F02P 3/01* (2013.01); *F02P 15/02* (2013.01)
USPC ..... 123/406.12; 123/605; 361/263

(58) Field of Classification Search
CPC ..... F02P 3/0435; F02P 9/007; F02P 37/02; F23Q 3/004; H01F 38/12
USPC ..... 123/406.12, 594, 596, 604–606, 609, 123/618, 620–623, 634, 650, 651; 361/23, 361/247, 253, 256, 263; 315/209 CD, 222
See application file for complete search history.

(56) References Cited

U.S. PATENT DOCUMENTS

| | | | |
|---|---|---|---|
| 4,245,609 | A | 1/1981 | Gerry |
| 4,320,735 | A | 3/1982 | Canup |
| 4,327,701 | A | 5/1982 | Gerry |
| 4,998,526 | A | 3/1991 | Gokhale |
| 5,113,839 | A | 5/1992 | Hartmann et al. |

(Continued)

FOREIGN PATENT DOCUMENTS

| | | | |
|---|---|---|---|
| CN | 1617438 | A | 5/2005 |
| KR | 20010045010 | A | 6/2001 |
| KR | 1020010110450 | A | 12/2001 |

*Primary Examiner* — John Kwon
*Assistant Examiner* — Johnny H Hoang
(74) *Attorney, Agent, or Firm* — Reinhart Boerner Van Duren P.C.

(57) ABSTRACT

A multiplexing drive circuit for an AC ignition system having a common leg that includes two switches coupled in series, and one or more dedicated legs, wherein each leg includes two switches coupled in series. The multiplexing drive circuit also includes a transformer for each of the one or more dedicated legs, each transformer having a primary winding coupled between one of the one or more dedicated legs and the common leg, and wherein each transformer has a secondary winding coupled in parallel to a spark plug, and a pulse-width modulated (PWM) switch controller configured to operate the common leg and dedicated leg switches to control characteristics of the spark discharge for the spark plug. Wherein the switch controller is capable of real time diagnostic checks by monitoring the time at which a spark discharge event takes place.

28 Claims, 11 Drawing Sheets

(56) References Cited

U.S. PATENT DOCUMENTS

| | | | | | |
|---|---|---|---|---|---|
| 5,505,175 | A | | 4/1996 | Mai et al. | |
| 5,563,473 | A | * | 10/1996 | Mattas et al. | 315/240 |
| 5,672,972 | A | | 9/1997 | McCoy et al. | |
| 6,123,057 | A | * | 9/2000 | Goras et al. | 123/406.2 |
| 6,135,099 | A | | 10/2000 | Marrs et al. | |
| 6,281,638 | B1 | * | 8/2001 | Moisin | 315/244 |
| 7,404,396 | B2 | | 7/2008 | Toriyama et al. | |
| 7,515,445 | B2 | * | 4/2009 | Lin | 363/98 |
| 8,350,488 | B2 | * | 1/2013 | Jin | 315/219 |
| 2006/0152169 | A1 | * | 7/2006 | Lurkens | 315/244 |
| 2008/0121214 | A1 | | 5/2008 | Bertsch et al. | |
| 2008/0135017 | A1 | * | 6/2008 | Naruse et al. | 123/406.12 |

* cited by examiner

MULTIPLEXING DRIVE CIRCUIT FOR AN AC IGNITION SYSTEM WITH CURRENT MODE CONTROL AND FAULT TOLERANCE DETECTION

CROSS-REFERENCE TO RELATED PATENT APPLICATION

This patent application is a Continuation-in-Part application of co-pending U.S. patent application Ser. No. 12/542,794, filed Aug. 18, 2009, the entire teachings and disclosure of which are incorporated herein by reference thereto.

FIELD OF THE INVENTION

This invention relates generally to ignition systems for internal combustion engines that use spark plugs and, more particularly, to ignition systems for internal combustion engines that use spark plugs and control systems for controlling spark plug operation and checking for system faults.

BACKGROUND OF THE INVENTION

Typically, internal combustion engines include spark plugs along with spark-generating ignition circuitry to ignite an air-fuel mixture in the cylinder of the engine. Some engines employ permanent magnets attached to a rotating flywheel to generate a voltage on a charge coil. In a typical capacitive discharge system, electrical energy from a low voltage battery is fed into a power supply that steps it up to a higher voltage on a capacitor, which provides the voltage necessary to cause an electrical spark across the spark gap of a spark plug. The capacitor transfers its energy into the primary winding of an ignition coil and into the magnetic core of the ignition coil. Energy is extracted from the ignition coil secondary winding until the capacitor and magnetic core are absent of sufficient energy. In an inductive system, energy is pulled from a low-voltage battery in the primary of the coil. When the current is interrupted in the coil primary winding, a flyback occurs which initiates breakdown on the secondary winding and energy from the ignition coil core is extracted via the secondary winding. In both capacitive discharge and inductive ignition systems, energy is transferred to the magnetic core of the ignition coil through current flow in the primary winding of the ignition coil at a time $T_1$. At a later time $T_2$, the ignition coil secondary voltage and current are produced from the energy stored in the magnetic core. The ability to change secondary coil characteristics of open circuit voltage (OCV), current amplitude (CA), and spark duration (SD) are all related to changing the energy stored in the magnetic core of the coil. However, once energy has been placed in the magnetic core, the secondary coil characteristics are for the most part predetermined to be whatever the secondary load allows and cannot be changed until the next firing.

For a given inductive or capacitive discharge coil design, OCV, CA, and SD are directly proportional to stored energy. As the energy stored in the magnetic core is increased, all three of these values increase. The biggest constraint in these systems is open circuit voltage. This parameter always has to be large enough to reliably initiate a spark. So there is some minimum energy that is required to be applied to the coil so that there is reliable spark generation. For typical inductive and capacitive discharge ignition systems, the OCV is on the order of 25-40 kV. This limits the amount of adjustability in CA and SD that is available through adjusting energy application. Further, CA and SD must both increase or both decrease. In conventional inductive or capacitive discharge coil designs, these parameters cannot be adjusted independently. To modify the overall response of the ignition system, it is generally necessary to modify the coil design. And, typically, for a given coil design, the relationship between the OCV, CA, and SD cannot be optimized for different engine operating conditions.

As an alternative to capacitive discharge and inductive ignition systems, some engine systems employ alternating current ignition (AC) systems. In an AC ignition system, the alternating current is typically developed by a DC-to-AC inverter. There are several types of inverters that may be used in such a system. For example, an exemplary AC ignition system includes a transformer with a center-tapped primary coil and a secondary coil connected to a spark plug. An arc may be initiated at the spark plug by discharging a capacitor to one of the windings of the center-tapped primary coil. Both of the primary coil terminals are connected to a switch or transistor. The switches can be alternated between on and off to reverse the direction of current flow in the primary coil and, therefore, in the secondary coil. Control of these switches may be effected in a manner that facilitates adjustment of the CA or SD period.

However, AC ignition systems generally use more power semiconductors, such as switches and diodes, than capacitive discharge and inductive systems. Or, alternatively, the AC ignition requires ignition coils with more than two windings, such as a center tapped coil primary arrangement. Generally, as coil complexity decreases, the use of power semiconductors increases and vice versa. This makes AC ignition systems more costly to build and potentially less reliable as the additional components and increased complexity provide more points of possible failure. Further, many AC ignition systems do not permit precise real-time control of the secondary coil current, which determines the characteristics of the spark discharge. Additionally, many AC ignition systems do not have the ability to self diagnose circuit failures or predict future circuit failures.

It would therefore be desirable to have an alternating current ignition system that can be built less expensively using fewer components than conventional alternating current ignition systems and be able to fire a simple two-winding ignition coil. It would also be desirable to have an ignition system that allows for a greater degree of precise real-time control of the SD and CA than typically found in conventional inductive, capacitive discharge, or alternating current ignition systems. Additionally, it would be useful to have an ignition system that does discover circuit failures or estimate possibilities of future failures.

Embodiments of the invention provide such an alternating current ignition system. These and other advantages of the invention, as well as additional inventive features, will be apparent from the description of the invention provided herein.

BRIEF SUMMARY OF THE INVENTION

In one aspect, an embodiment of the invention provides a multiplexing drive circuit for an AC ignition system having a common leg that includes two switches coupled in series, and one or more dedicated legs, wherein each dedicated leg includes two switches coupled in series. The AC ignition system also includes a transformer (with two-winding ignition coil) for each of the one or more dedicated legs, each transformer having a primary winding coupled between one of the one or more dedicated legs and the common leg. Furthermore, each transformer has a secondary winding coupled in parallel to a spark plug. The AC ignition system also includes a pulse-width modulated (PWM) switch controller configured to operate the common leg and dedicated leg switches to control characteristics of the spark discharge for the spark plug.

In another aspect, an embodiment of the invention provides a programmable AC ignition system that includes a DC electrical bus, a plurality of spark plugs, each coupled to a secondary winding of a respective transformer. Each transformer includes a primary winding having a first terminal coupled between a respective pair of dedicated switches coupled in series. The programmable AC ignition system also has a pair of shared switches coupled in series, wherein a second terminal of each primary winding is coupled between the shared switches, and wherein the shared switches and each of the dedicated switches are coupled to the DC bus. The AC ignition system has a programmable controller configured to operate the shared switches and dedicated switches using pulse width modulation, wherein controlling the shared and dedicated switches comprises controlling spark discharge characteristics for the plurality of spark plugs. Further, the programmable controller is capable of detecting system failures. Additionally, the programmable controller is capable of predicting spark plug failure or a misfire condition based on the length of time it takes for the spark event to occur once power is supplied to the ignition system.

Other aspects, objectives and advantages of the invention will become more apparent from the following detailed description when taken in conjunction with the accompanying drawings.

BRIEF DESCRIPTION OF THE DRAWINGS

The accompanying drawings incorporated in and forming a part of the specification illustrate several aspects of the present invention and, together with the description, serve to explain the principles of the invention. In the drawings.

While the invention will be described in connection with certain preferred embodiments, there is no intent to limit it to those embodiments. On the contrary, the intent is to cover all alternatives, modifications and equivalents as included within the spirit and scope of the invention as defined by the appended claims.

DETAILED DESCRIPTION OF THE INVENTION

Figure 1:
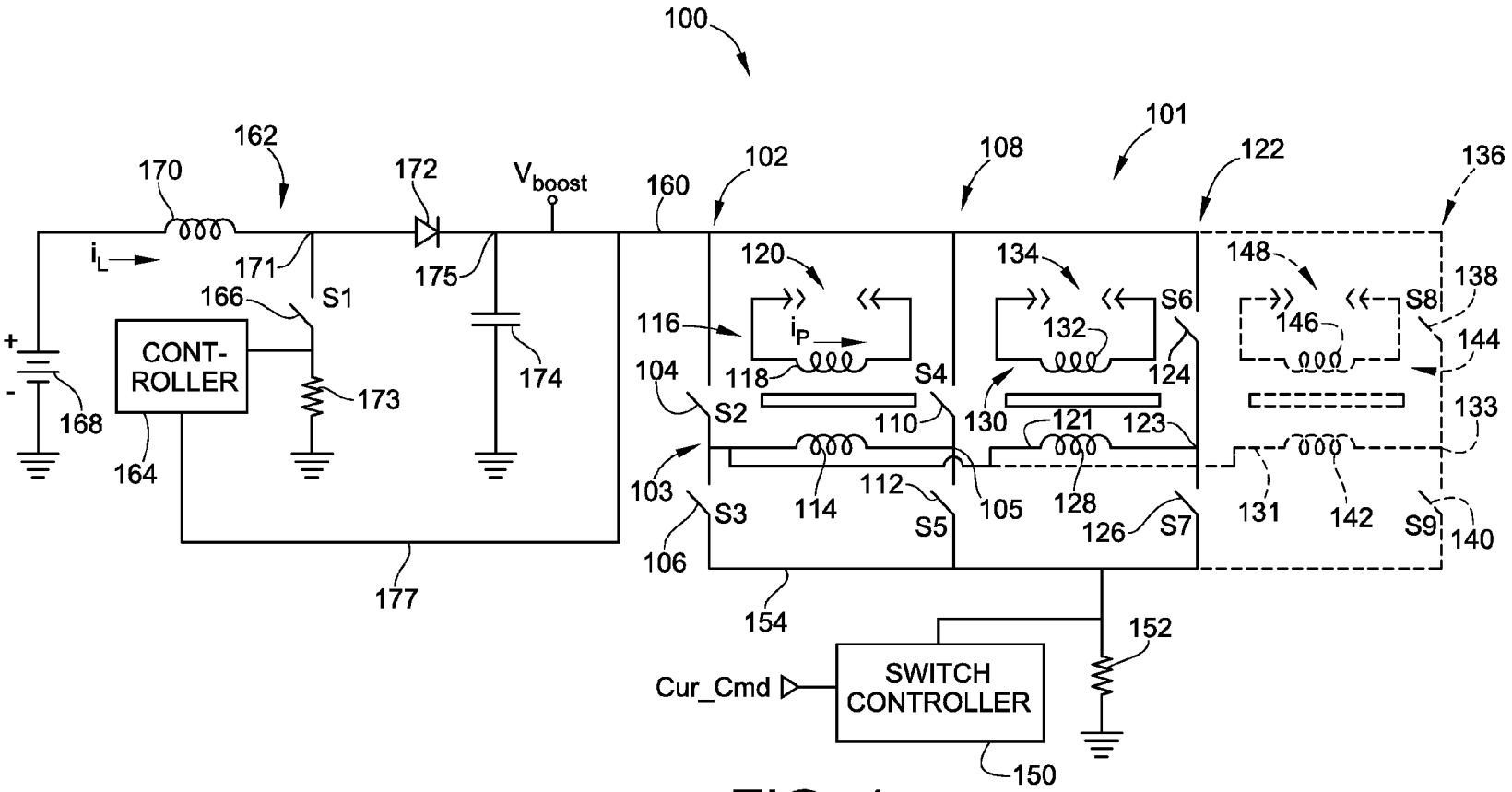
FIG. 1 is a schematic diagram of an AC ignition system module having a multiplexing drive circuit, according to an embodiment of the invention.

FIG. 1 illustrates an exemplary alternating current (AC) ignition system module 100 having a multiplexing drive circuit 101, according to an embodiment of the invention. Ignition system module 100 can be configured as a 3-channel, that is, coupled to three spark plugs, or a two-channel module, that is, coupled to two spark plugs, and includes a shared, or common, leg 102 having two switches S2, 104 and S3, 106 coupled in series. A first dedicated leg 108 has two switches S4, 110 and S5, 112 coupled in series. One terminal 103 of a primary winding 114 of a first ignition coil or transformer 116 is coupled between switches S2, 104 and S3, 106, while the other terminal 105 of the primary winding 114 is coupled between switches S4, 110 and S5, 112. A secondary winding 118 of the first transformer 116 is coupled in parallel with a first spark plug 120. Because the ignition coils in the present invention do not have to store as much energy as ignition coils in prior art ignition systems, the ignition system in the present invention can is configured to use ignition coils that are designed essentially to operate as high-voltage transformers rather than energy storage devices.

A second dedicated leg 122 includes two switches S6, 124 and S7, 126 coupled in series. The second dedicated leg 122 is coupled in parallel with the first dedicated leg 108 and the common, leg 102. A first terminal 121 of a primary winding 128 of a second ignition coil or transformer 130 is coupled between switches S2, 104 and S3, 106, while a second terminal 123 of primary winding 128 is coupled between switches S6, 124 and S7, 126. A secondary winding 132 of the second transformer 130 is coupled in parallel with a second spark plug 134.

In an alternate 3-channel embodiment of the invention, a third dedicated leg 136 (shown in phantom) includes two switches S8, 138 and S9, 140 coupled in series. One terminal 131 of a primary winding 142 of a third transformer 144 (shown in phantom) is coupled between switches S2, 104 and S3, 106, while the other terminal 133 of the primary winding 142 is coupled between switches S8, 138 and S9, 140. A secondary winding 146 of the third transformer 144 is coupled in parallel to a third spark plug 148.

As will be apparent from the following, the common leg 102 is referred to as the shared, or common, leg because it may be connected to more than one primary winding of the transformers for the spark plugs in the ignition system. The common leg 102 and the three dedicated legs 108, 122, 136 are each coupled in parallel. In contrast, each dedicated leg 108, 122, 136 is coupled to a different primary winding of a transformer. Each primary winding is coupled to a different spark plug.

In one embodiment, the switches are N-channel field effect transistors (FETs). In an alternate embodiment, the switches are metal oxide semiconductor field effect transistors (MOSFETs), and in another embodiment, the switches are insulated gate bipolar transistors (IGBTs). However, it is contemplated that other types of switches may be used as switches according to embodiments of the invention. In yet another embodiment of the invention, each of the one or more switches has a diode coupled in anti-parallel.

A pulse-width modulation (PWM) switch controller 150 is coupled to a current-sensing resistor 152 and to a neutral line 154, which connects to a common terminal of common leg 102 and of dedicated legs 108, 122, 136. In an embodiment of the invention, the PWM switch controller 150 is implemented as a field-programmable gate array (FPGA). When the switches are MOSFET or IGBT transistors, the PWM switch controller 150 is coupled to gates of the transistors to control switch operation. Further, the PWM switch controller 150 may be configured for high-frequency operation, 5-55 kilohertz, for example. The high-frequency operation of the switch controller 150 allows for precise control of the primary winding current level. A high coupling factor between the primary and secondary windings means that precise control of the primary winding current results in precise, and real time, control the secondary winding current. Such control of the secondary current enables the control of spark discharge characteristics, such as CA and SD. Accordingly, the PWM switch controller 150 is configured to alter these parameters for a particular spark discharge while the discharge is taking place.

In an embodiment of the invention, electrical energy for spark generation is drawn from a DC power bus 160 of DC-to-DC boost converter 162. The boost converter 162 includes a controller 164 that operates a switch S1 166. Through its control of switch S1 166, the controller 164 regulates the output voltage, that is, the DC power bus 160 voltage of the boost converter 162. A battery 168 supplies an electrical current to an inductor 170. The inductor terminal 171 opposite the battery 168 is coupled to a diode 172 and to the switch S1 166. The switch S1 166 is, in turn, coupled to a current sensing resistor 173 and to the controller 164. The diode terminal 175 opposite the inductor 170 is coupled to a capacitor 174, to the DC power bus 160, and to a voltage feedback line 177 coupled to the controller 164.

In an exemplary embodiment of the invention, the battery 168 supplies 24 volts DC, which is boosted to approximately 185 volts at the DC power bus 160. The switch S1 166 is modulated using pulse-width modulation in order to create a predetermined average current $I_L$. Current $I_L$ will have an AC ripple component (e.g., approximately ±6 amperes, for example) that is less than the DC component (approximately 34 amperes, for example). The current $I_L$ is a continuous, constant current when the boost converter 162 is "on." The current $I_L$ will provide packets of current through diode 172 to capacitor 174 when switch S1 166 is off during the S1 modulation when the boost converter 162 is "on." These packets of current will flow into capacitor 174 which will increase the voltage on the capacitor 174. The voltage feedback line 177 is used by the controller 164 to turn "off" the boost converter 162 at a predetermined voltage level (i.e., 185 volts). At this point, S1 modulation will cease and switch S1 166 will be left in an open state. The current $I_L$ will then start decreasing to zero. When the voltage $V_{boost}$ decreases to a second predetermined level, the boost converter 162 will turn "on" again and high frequency S1 modulation will be reinitiated in order to develop the appropriate DC current $I_L$ through the inductor 170, to maintain a stiff 185 volts on the DC bus.

For control of the spark characteristics in spark plug 120, switches S2 104 and S5 112 work together as a pair. They are either both on or both off. Switches S3 106 and S4 110 also work together as a pair and are operated in the inverse state of switches S2 104 and S5 112. The initial ionization of the spark plug gap in the first spark plug 120 is created by switching S3 106 and S4 110 on. In an exemplary embodiment, the transformers 116, 130, 144 have a primary winding to secondary winding turn ratio of approximately 1:180. When S3 106 and S4 110 turn on, the 185 volts on DC power bus 160 is placed across the primary winding 114. This places a high voltage across the secondary winding 118. When the voltage across the spark plug gap ($V_{SP}$) is sufficiently high (from 5 to 40 kilovolts, for example), the spark plug gap will ionize. At this point, the spark plug gap no longer looks like an open circuit, but rather more like a zener diode. As long as the secondary winding 118 of the transformer 116 is able to exceed the zener voltage, or sustaining voltage, of the spark plug gap, the spark gap will remain ionized and the spark discharge will continue. The sustaining voltage across the spark plug gap during spark discharge will drop, reducing $V_{SP}$ to a voltage between 300 volts and 3000 volts. The polarity of $V_{SP}$ is determined by the direction of current flow.

In the same manner as described above, switches S2 104 and S7 126 work together as a pair, either both on or both off. Switches S3 106 and S6 124 also work together as a pair and are operated in the inverse state of switches S2 104 and S7 126. Together, switches S2 104, S7 126, S3 106, and S6 124 are operated to control the spark discharge characteristics for the second spark plug 134. Similarly, switches S2 104 and S9 140 (shown in phantom) work together as a pair, either both on or both off. Switches S3 106 and S8 138 (shown in phantom) also work together as a pair and are operated in the inverse state of switches S2 104 and S9 140. Together, switches S2 104, S9 140, S3 106, and S8 138 are operated to control the spark discharge characteristics for the third spark plug 148.

During operation of the AC ignition system, a current $I_P$ flows through the primary coil 114 when switches S2 104 and S5 112 are on (i.e., closed). When $I_P$ reaches a predetermined level (30 to 150 amperes, for example), the switch controller 150 turns S2 104 and S5 112 off, while turning switches S3 106 and S4 110 on. When switches S3 106 and S4 110 are on, the current $I_P$ through the primary winding 114 changes direction, thus defining the AC operation of the ignition system. Switches S3 106 and S4 110 will be held in an on state until the current $I_P$ reaches a predetermined value of equal magnitude but opposite polarity of the S2 104 and S5 112 switch peak current. Thus, the current $I_P$ takes on a high-frequency triangular shape. The current $I_S$ that flows in the secondary winding is of the same shape and phase as the primary winding current $I_P$ but scaled based on the primary winding to secondary winding turn ratio.

The transformers 116, 130, 144 have low-inductance primary and secondary windings relative to the windings found on typical ignition coils. The low inductance of the primary and secondary windings of the three transformers, shown in FIG. 1, allows for tight coupling of the primary winding current and the secondary winding current. The low inductances also allow for precision control of the primary winding and secondary winding currents. By precisely controlling the primary winding current, the secondary winding current is also precisely controlled.

In an exemplary embodiment of the invention, the transformers have a primary inductance of approximately 109 microhenries, a secondary inductance of approximately 3.7 henries, a primary leakage inductance of approximately 28 microhenries, and a secondary leakage inductance of approximately 0.95 henries. Additionally, the transformers have a primary coupling factor of approximately 0.8630, a secondary coupling ratio of approximately 0.8630, and a turns ratio of approximately 184 to one. The time rate of change in the current through the primary and secondary windings of the transformer is dictated by the leakage inductances or coupling factors. The coupling factor can be determined according to the following equation:

$$1-k^2=L_{ps}/L_p=L_{sp}/L_s, \quad (1)$$

where k is the coupling factor, $L_p$ is the primary inductance with the secondary open, $L_s$ is the secondary inductance with the primary open, $L_{ps}$ is the primary inductance with the secondary shorted (leakage at primary), and $L_{sp}$ is the secondary inductance with the primary shorted (leakage at secondary). This sets the frequency of oscillation for a given current setting. As the current value increases, the frequency decreases. When coupled to a 185-volt nominal bus, this transformer oscillates at approximately 12 kHz to 55 kHz as the output current level decreases from 300 mA (rms) to 65 mA (rms). With respect to the inductances and coupling factors discussed herein, "approximately" is defined as plus or minus 25%, as a number of factors can affect these values, including inter-winding capacitance, skin effects, proximity effects, measurement methods, and product variation.

In another exemplary embodiment of the invention, the transformers have a primary inductance of approximately 246 microhenries, a secondary inductance of approximately 8.11 henries, a primary leakage inductance of approximately 61 microhenries, and a secondary leakage inductance of approximately 2.04 henries. Additionally, the transformers have a primary coupling factor of approximately 0.8672, a secondary coupling ratio of approximately 0.8651, and a turns ratio of approximately 182 to one. When coupled to a 185-volt nominal bus, this transformer oscillates at approximately 5 kHz to 29 kHz as the output current level decreases from 300 mA (rms) to 65 mA (rms).

Figure 2A:
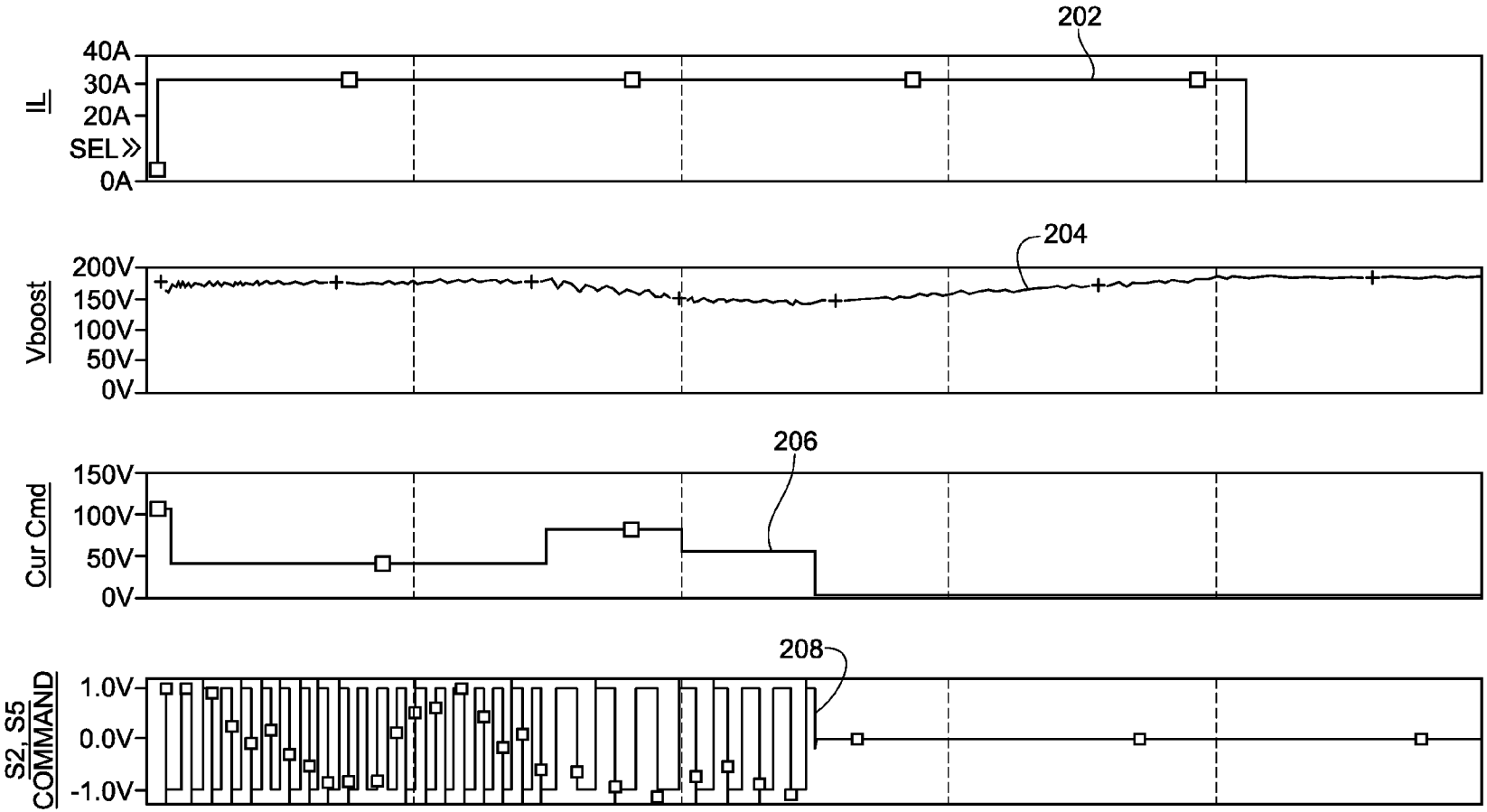
FIGS. 2A and 2B are timing diagrams showing the basic voltage and current waveforms during exemplary operation of the ignition system of FIG. 1.
Figure 2B:
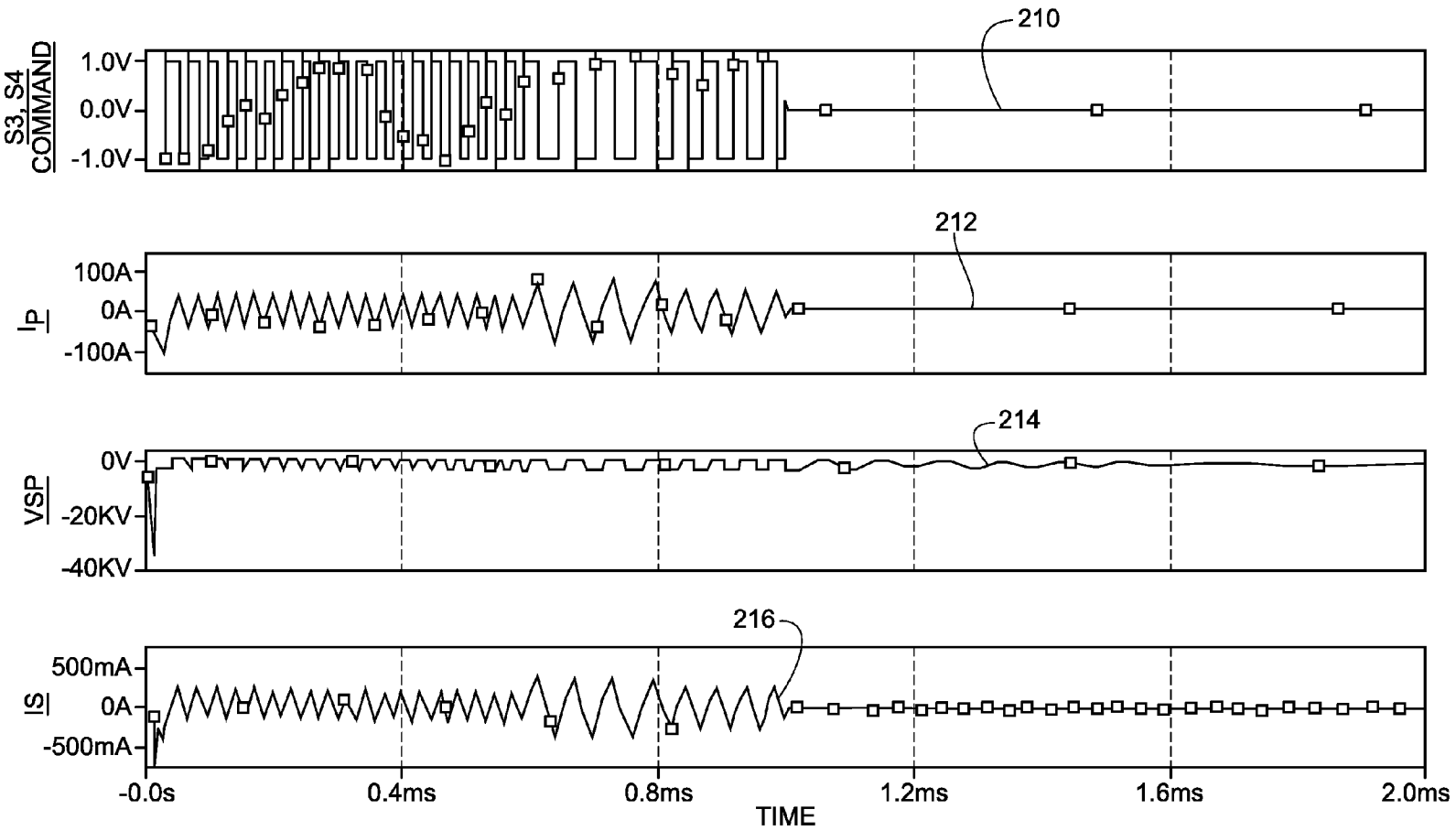

FIGS. 2A and 2B are timing diagrams that illustrates the basic voltage and current waveforms during intended operation of the ignition system module 100 of FIG. 1. The $I_L$ waveform 202 shows the input current to the boost converter. The small ripple is not apparent in this simulation output. Note the $I_L$ is off at time equal to zero. When the voltage $V_{boost}$ decrease below 180 volts, $I_L$ starts to conduct, $I_L$ continues to conduct even after the spark is turned off at the 1 msec point. Current $I_L$ flows until $V_{boost}$ is back to 185 volts.

The $V_{boost}$ waveform 204 shows the 185 volts DC output voltage of the boost converter. There is some voltage sag during the heavy loading of the ignition event. However, the basic concept of this scheme is for the voltage $V_{boost}$ to be a constant value. The voltage sag shown in the simulation is a result of non-ideal or pragmatic power supply design choices.

The Cur_Cmd waveform 206 shows the AC magnitude commanded for the primary current $I_P$. Note that the peaks of the current $I_P$ correspond to the Cur_Cmd trace. Also note that Cur_Cmd can be changed nearly instantaneously, as shown in FIGS. 2A and 2B, with a corresponding, and nearly instantaneous, response of $I_P$.

An S2, S5 Command waveform 208 shows the state of switches S2 104 and S5 112. When the signal is +1 (high), the switches 104, 112 are closed. When the signal is −1 (low), the switches 104, 112 are open. An S3, S4 Command waveform 210 shows the state of switches S3 106 and 110 S4. When the signal is +1 (high) the switches 106, 110 are on. When the signal is −1 (low), the switches 106, 110 are off. Note that the S2, S5 Command waveform 208 is out of phase with the S3, S4 Command waveform 210.

The $I_P$ waveform 212 shows the ignition coil primary current. Note that this current has a triangular AC shape. The magnitude of the AC current is determined by the Cur_Cmd signal. The frequency of the AC current is result of the $V_{boost}$, LP, and Cur_Cmd. As the magnitude of Cur_Cmd increases, the frequency decreases. During breakdown the Cur_Cmd is approximately 100 amperes. After breakdown, Cur_Cmd is changed to approximately 50 amperes. At 600 μsec and 800 μsec, Cur_Cmd is changed and $I_P$ responds accordingly.

The $V_{SP}$ waveform 214 shows the voltage at the spark plug electrodes. Note that the breakdown in this simulation occurs at approximately 35 kilovolts. After which, $V_{SP}$ is reduced to the sustaining voltage which has a magnitude of approximately 1000 volts in this simulation. Also note that the polarity of $V_{SP}$ is determined by the direction of current $I_S$.

The Current $I_S$ waveform 216 is a scaled reflection of $I_P$ (i.e., a triangle wave) per the turns ratio in the ignition coil. Current $I_S$ and the ability to instantaneously change its magnitude is a feature of the embodiment shown in FIG. 1. Note that the first negative peak is quite high and follows the Cur_Cmd waveform 206. After breakdown Cur_Cmd is reduced and the amplitude of $I_S$ reduces accordingly. At approximately 600 μsec, Cur_Cmd steps higher and so does the amplitude of current $I_s$. At approximately 800 μsec, Cur_Cmd is changed again and so is current $I_s$. At approximately 1000 μsec, Cur_Cmd goes to zero and $I_S$ stops flowing. This causes termination of the spark.

The programmability of spark discharge characteristics in the present invention allows for the choice of a wide range of CAs and SDs. For example, an embodiment of the invention allows for spark discharge times to programmed over a range of 0.1 to 4.0 milliseconds, and for the CA to be programmed over a range of 50 to 1000 milliamps. This, in turn, allows for a single ignition system design to be used in a number of different engine designs and configurations. Rather than designing and manufacturing an entire family of ignition systems for different engines, embodiments of the present invention contemplates one ignition system design that can be programmed to work with many different models of engine. Such programmability may be realized partially or entirely in a programmable device or controller software.

The programmability of the ignition system described herein also facilitates a longer useful life for the spark plugs used in the system. Over the lifetime of an engine, the replacement of spark plugs can be a costly and time-consuming aspect of the engine's overall maintenance. In a typical spark plug, the spark gap increases as the electrodes become worn. Over time, this may lead to an increase in both the breakdown voltage and sustaining voltage. Other factors, such as break mean effective pressure, which can increase with engine load may also influence in-cylinder conditions including the spark discharge characteristics during engine operation. It is also possible for the user to intentionally vary certain engine parameters that affect spark discharge characteristics. Changes, such as these, can be detected by the switch controller 150, which can then add energy to the spark during the spark discharge, if necessary, to keep the spark characteristics within acceptable operational limits. This is accomplished by tightly coupling the primary and secondary currents. In embodiments of the present invention, the secondary current can be controlled in real time via control of the primary current.

Figure 4:
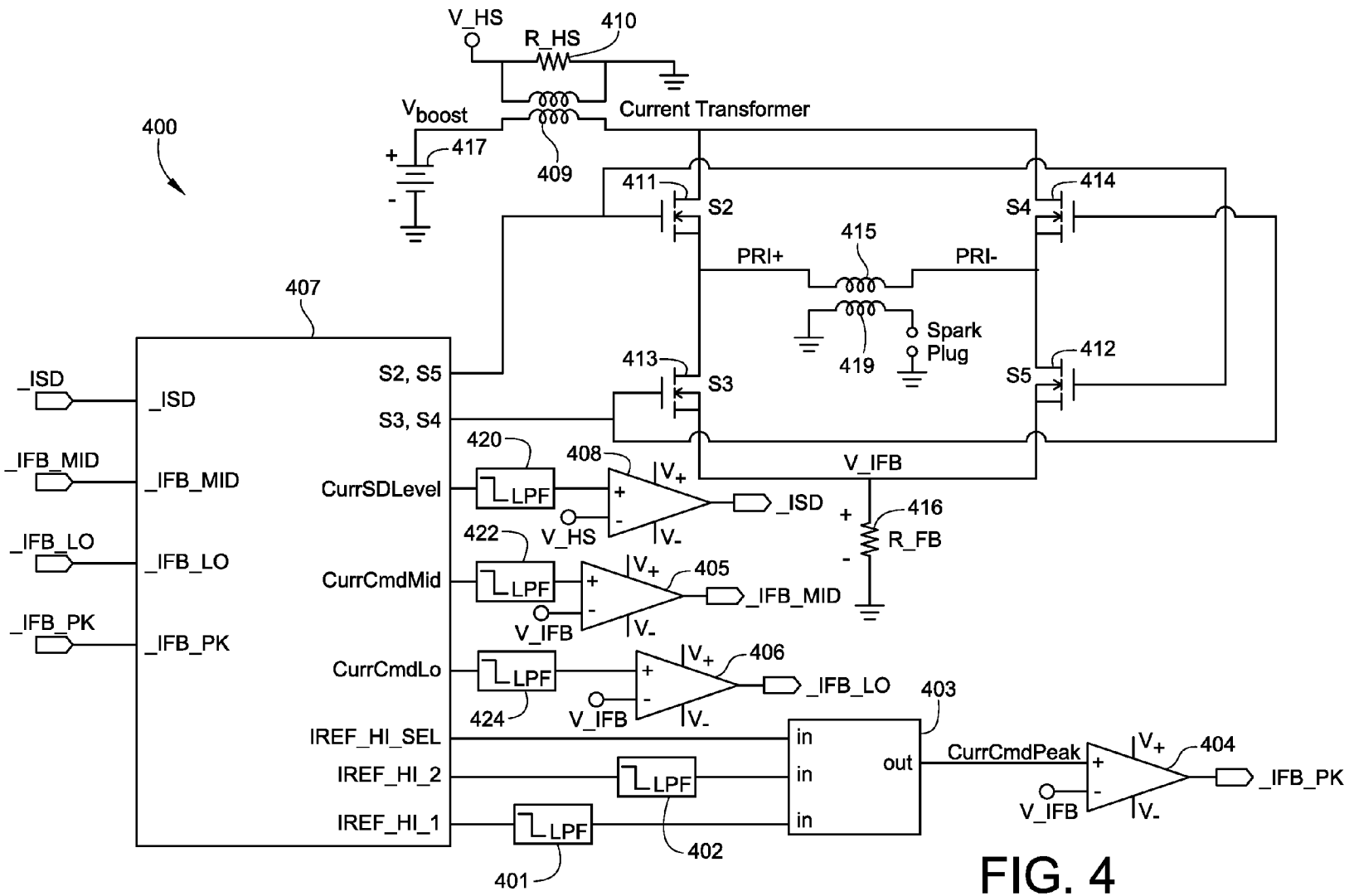
FIG. 4 is a circuit diagram for a programmable control system.

In another embodiment, the programmable control is an FPGA configured to control the current in the primary coil and to detect circuit failures. FIG. 4 illustrates an FPGA control circuit 400 along with just a single stage of a multiplexing drive circuit for an AC ignition system. Even though just a single stage is shown, the control circuit contemplated could control additional stages as well. The FPGA 407 output signals IREF_HI_1, and IREF_HI_2 couple to low pass filters 401 and 402 respectively. The outputs of low pass filter 401 and low pass filter 402 along with IREF_HI_SELECT are coupled to the inputs of switch 403. The output of switch 403, which is referred to as CurrCmdPeak, is coupled to the positive input of comparator 404. The input into the negative terminal of comparator 404 is V_IFB. The output of comparator 404 is _IFB_PK, which is coupled to FPGA 407 as an input.

IREF_HI_1 and IREF_HI_2 are pulse width modulated (PWM) control signals that set a threshold value for the current in the primary ignition coil. The FPGA control circuit 400 controls the current in the primary ignition coil by setting appropriate duty cycles for IREF_HI_SELECT, IREF_HI_1 and IREF_HI_2 prior to an ignition event. Low pass filters 401 and 402 convert the PWM signals IREF_HI_1 and IREF_HI_2 to DC voltage command values, while IREF_HI_SELECT controls switch 403. IREF_HI_SELECT allows the FPGA control circuit 400 to instantaneously switch between the two DC voltage command values IREF_HI_1 and IREF_HI_2. The selected DC voltage command value is then compared to V_IFB by comparator 404. V_IFB represents the voltage measured across resistor 416 and is proportional to the current flowing through the primary ignition coil 415. Therefore, whenever V_IFB reaches the specified DC voltage command value (either filtered IREF_HI_1 or IREF_HI_2) the output of comparator 404_IFB_PK will tell FPGA 407 to toggle the switching network in the multiplexing drive circuit, as previously discussed.

Furthermore, IREF_HI_SELECT can instantaneously select between IREF_HI_1 and IREF_HI_2. During an initial ignition cycle, FPGA 407 can change the IREF_HI_1 and IREF_HI_2 PWM signals to adapt to changing conditions in the overall ignition system. For example, IREF_HI_SELECT may start the ignition cycle using IREF_HI_1 and switch to IREF_HI_2 during the ignition cycle. While currently operating under IREF_HI_2, FPGA 407 can then change the duty cycle of the PWM signal of IREF_HI_1 to create yet another control point for the switching network in the multiplexing drive circuit.

Figure 5:
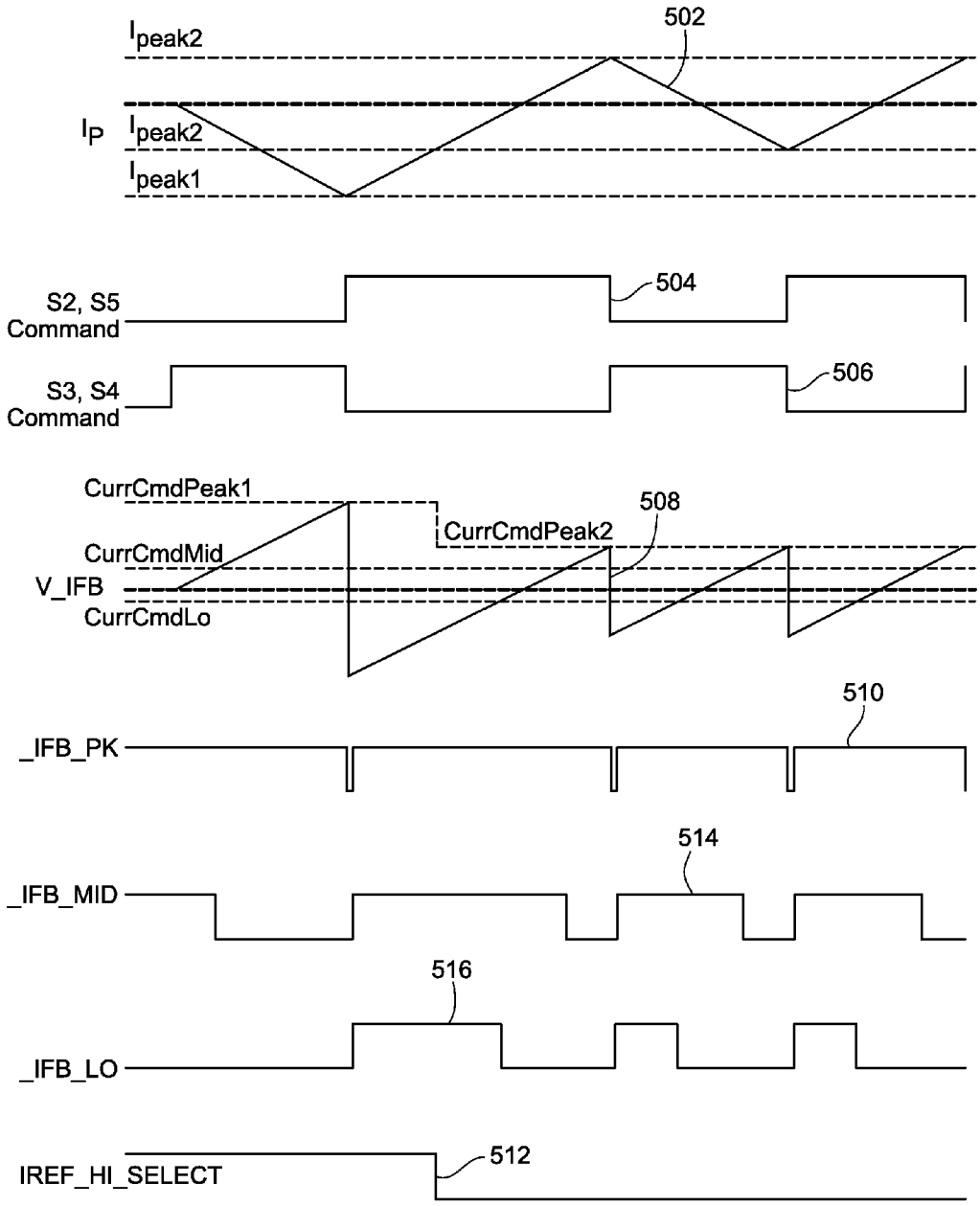
FIG. 5 contains timing diagrams showing the basic voltage and current waveforms during exemplary operation of the ignition system of FIG. 4.

FIG. 5 contains timing diagrams that illustrate an example of the basic voltage and current waveforms during intended operation of the FPGA control circuit 400 of FIG. 4. The $I_P$ waveform 502 shows the current in the primary coil 415. Notice how the peaks of the waveform correspond exactly with the peaks of the V_IFB waveform 508.

The V_IFB waveform 508 illustrates the relationship between $I_P$ 502 and the voltage across resistor 416. Superimposed on top of the V_IFB waveform 508 is the CurrCmdPeak set by the IREF_HI_SELECT from FPGA 407.

The S2, S5 Command waveform 504 shows the drive signal for S2 411 and S5 412 generated by FPGA 407. The S3, S4 Command waveform 506 shows the drive signal for S3 413 and S4 414 generated by FPGA 407. Notice how the two waveforms have exactly opposite phase, and the transitions from high to low or low to high occur when V_IFB reaches one of the various CurrCmdPeak levels.

The _IFB_PK waveform 510 shows the output of comparator 404 from FIG. 4. When the V_IFB waveform exceeds CurrCmdPeak, the _IFB_PK waveform falls indicating to FPGA 407 that the desired peak current threshold has been achieved. At this point, FPGA 407 toggles the S2, S5 Command 504 and S3, S4 Command 506 waveforms thereby changing the operational state of the switching network.

The IREF_HI_SELECT waveform 512 shows the FPGA 407 command signal that tells the switch 403 to toggle between IREF_HI_1 and IREF_HI_2, which in turn sets a new level of CurrCmdPeak. Notice how this relationship is shown in the superimposed CurrCmdPeak line in the V_IFB waveform 508.

Additionally, the FPGA control circuit 400 has diagnostic capabilities. The FPGA control circuit 400 can detect several circuit failures, including: a short circuit condition across the primary coil 415; an open circuit condition across the primary coil 415; and a short circuit condition between either the positive or negative (PRI+ and PRI−) side of the primary ignition coil 415 and ground.

In FIG. 4, the FPGA control circuit 400 contains comparators 405, 406, and 408. CurrentCmdMid is a FPGA PWM output signal that passes through low pass filter 422 creating a DC reference voltage that is coupled to the positive input of comparator 405 for comparison to V_IFB, which is coupled to the negative input of comparator 405. CurrentCmdLo is another FPGA PWM output signal that passes through low pass filter 424 creating a DC reference voltage that is then coupled to the positive input of comparator 406 for comparison to V_IFB, which is coupled to the negative input of comparator 406. CurrSDLevel is yet another FPGA PWM output signal that passes through low pass filter 420 creating a DC reference voltage that is coupled to the positive input of comparator 408 for comparison to V_HS, which is coupled to the negative input of comparator 406. The outputs of comparators 405, 406, and 408 are _IFB_MID, _IFB_LO, and _ISD respectively.

Essentially, CurrSDLevel, CurrCmdMid, and CurrCmdLo generate voltage reference parameters that are compared to system parameters. Specifically, the system parameters being compared are the voltage across resistor 416 (V_IFB), which corresponds to the current in the primary coil 415, and the voltage across resistor 410 (V_HS), which corresponds to the current through the primary coil of the current transformer 409. In FIG. 4 they are shown to derive from FPGA 407, but the voltage reference points can also be derived from separate DC reference circuits as well. _ISD, _IFB_MID, and _IFB_LO, outputs of comparator 408, comparator 405, and comparator 406 respectively, are signals that tell FPGA 407 that the current in the primary coil 415 has reached some specific level.

Specifically, _IFB_LO is a trigger signal to the FPGA 407 that indicates the current in the primary coil 415 has reached a predefined low level. This functionality is displayed in the _IFB_LO waveform 516 from FIG. 5. Notice how _IFB_LO transitions from high to low when the V_IFB waveform 508 crosses the superimposed CurrCmdLo generated voltage reference line. Similarly, _IFB_MID is a trigger signal to the FPGA 407 that indicates the current in the primary coil 415 has reached a predefined middle level. This functionality is displayed in the _IFB_MID waveform 514 from FIG. 5. Notice how _IFB_MID transitions from high to low when the V_IFB waveform 508 crosses the superimposed CurrCmdMid generated voltage reference line.

_ISD is a trigger signal telling the FPGA 407 when excessive current is pulled from the source $V_{boost}$. To create this signal the DC reference signal generated from CurrSDLevel is compared to V_HS in comparator 408. V_HS is the voltage across resistor 410, which is a reflection of the current passed through the primary coil of current transformer 409, as shown in FIG. 4.

During normal operation of the AC ignition system 400, current is drawn from the source to supply the rest of the system. Current passing through the primary side of current transformer 409 induces a current in the secondary of current transformer 409, which in turn creates a voltage across resistor 410. Thereby generating V_HS for use with comparator 408.

By monitoring _IFB_MID, _IFB_LO, and _ISD, FPGA 407 can detect the failures previously mentioned. Specifically, a short circuit condition across the primary coil 114 will be detected by both _IFB_LO and _IFB_MID being triggered earlier than expected. An open circuit condition across the primary coil 114 will be detected by _IFB_LO and _IFB- _MID never being triggered. A short circuit condition between the negative side of the primary ignition coil (shown as PRI− in FIG. 4) and ground will be detected by ISD going high. This is because of the short circuit condition between PRI− and ground will pull excessive current from the source thus triggering _ISD.

Another potential circuit failure is a short circuit condition between PRI+ (from FIG. 4) and ground. In the particular implementation described here, a failure condition where a short circuit exists between PRI− and ground is detected by comparator 408 (from FIG. 4). But a similar failure condition where PRI+ is short circuit to ground is not detected because switches S3 and S4 413, 414 are always asserted first. Because of this choice current will always initially flow through the current transformer into switch S4 414, then through the primary coil 415, then through switch S3 413 to resistor 416, and finally to ground. When the FPGA 407 asserts switches S2 and S5 411,412 and deasserts switches S3 and S4 413, 414 the current transformer 409 current will be forced to an instantaneous step change due to the current already flowing in the ignition coil primary 415 which is a much larger inductance than the current transformer 409. This step change in the current transformer 409 current has very high frequency content which excites a resonance in the 409 and 410 circuit. This will cause a severe ringing effect back into the current transformer 409 thereby giving an erroneous voltage measurement V_HS. Effectively, the circuit dynamic just described makes _ISD useless in this specific case.

The circuit could operate with switches S2 and S5 always asserted first. This would make the failure condition of a short from PRI+ to ground possible to be discovered by _ISD, and the failure condition of a short from PRI− to ground would be difficult to discover.

Figure 6:
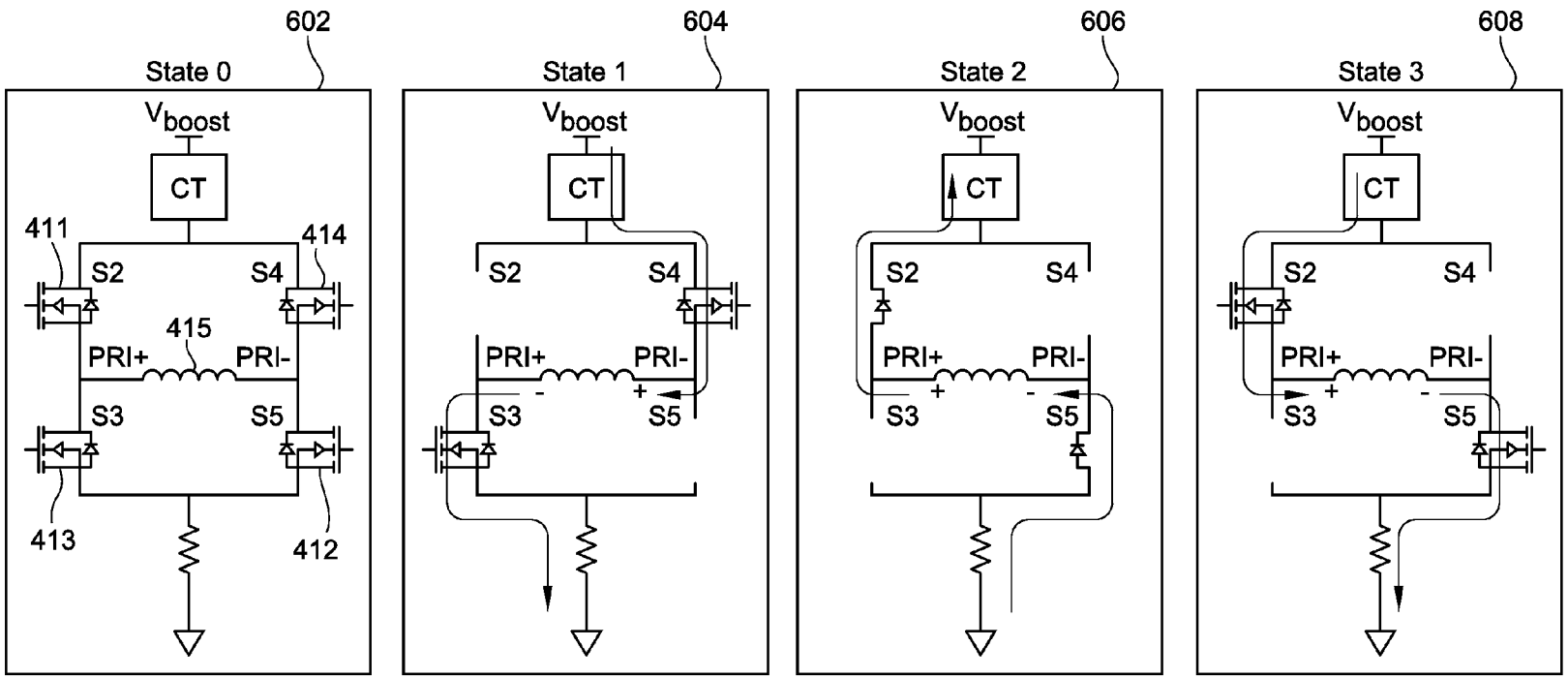
FIG. 6 shows exemplary operation of a specific aspect of the circuit in FIG. 4.

To detect an error when switches S3 and S4 413, 414 are asserted first, the AC ignition system is operated slightly differently, as depicted in FIG. 6. Notice that switches S2 411, S3 413, S4 414, and S5 412 are MOSFET switches, as shown in State 0 602. While MOSFET switches are shown here it is contemplated that any switch that is unidirectional with respect to voltage and bidirectional with respect to current could be used. Specifically, an IGBT in conjunction with a diode in parallel to mimic the body diode effect of the MOSFET could be used, as is well known in the field.

During exemplary operation without any circuit failures, the AC ignition system operates as follows. Similar to before, the first AC ignition cycle starts with S3 413 and S4 414 turning on, as shown in State 1 604. After peak current is achieved, S3 413 and S4 414 are turned off and the second switch cycle is started. However, instead of turning on switches S2 411 and S5 412 all switches S2 411, S3 413, S4 414, and S5 412 are held in the off position. At this point, there is negative current flowing through the primary coil 415. When all four MOSFET switches are turned off and there is not an abnormal short present, the body diodes of MOSFET switch S2 411 and S5 412 commutate on and flow the primary coil 415 current through the S2 411 and S5 412 structures similar to an on state for switches S2 411 and S5 412, as shown in State 2 606. As S2 411 and S5 412 body diodes are commutated on, the voltage applied across the primary coil 415 is equal to $V_{boost}$ that in turn drives the normal current through the primary coil 415 that would have been observed if both S2 411 and S5 412 had been turned on. Reverse current flow is only very brief so once the _IFB_LO comparator signals to the FPGA 407 (from FIG. 4) that the current through the primary coil 415 is acting as expected, switches S2 411 and S5 412 will actually be asserted by the FPGA control circuitry 400, as shown in State 3 608.

Figure 7:
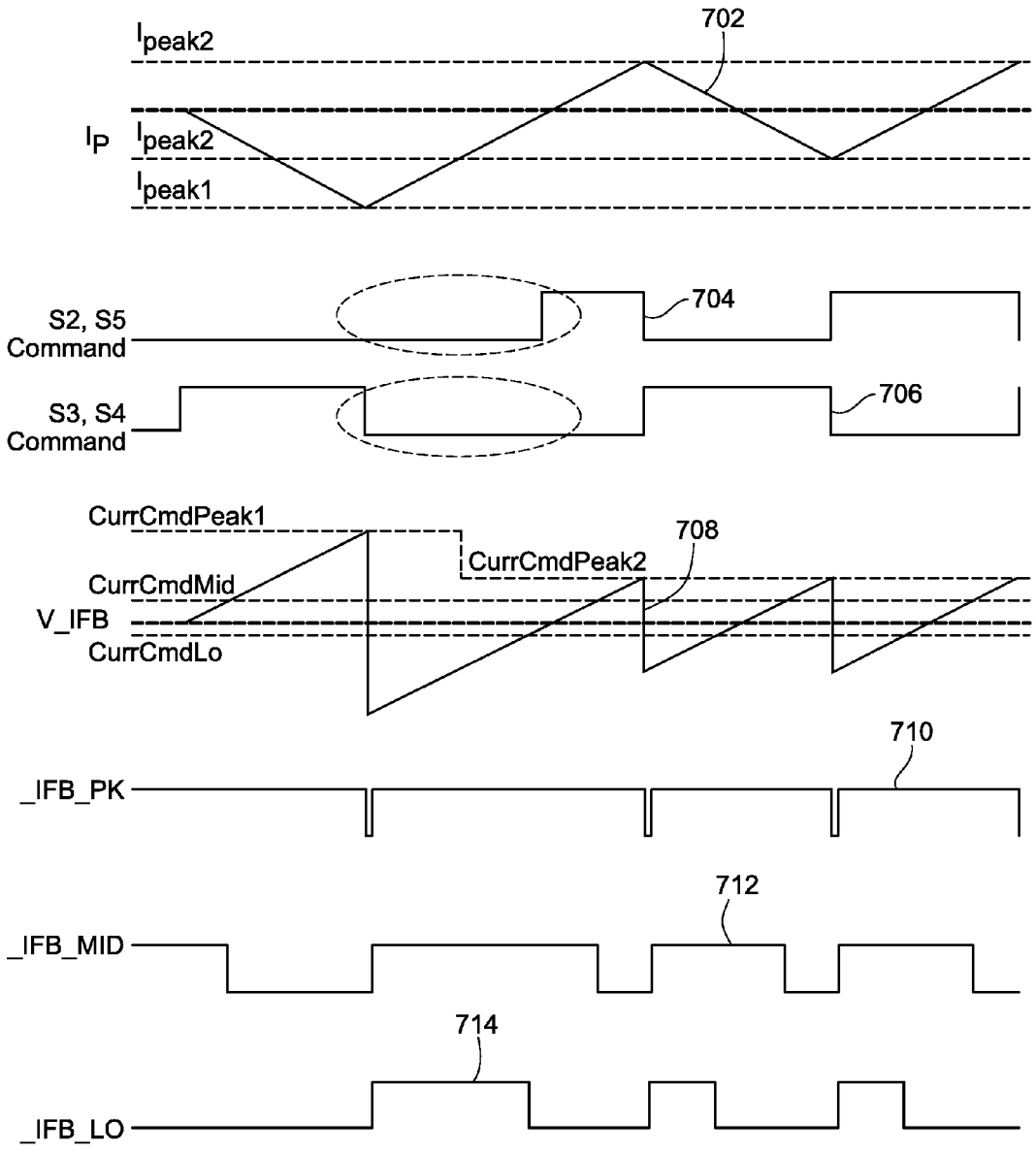
FIG. 7 contains timing diagrams showing the basic voltage and current waveforms during exemplary operation of the circuit in FIG. 4 when operated in the fashion shown in FIG. 6.

Normal operation of this additional step is shown in FIG. 7. Notice how, after the S3, S4 Command waveform 706 is deasserted, the S2, S5 Command waveform 704 is in the same state as the S3, S4 Command waveform 706 until the falling edge of _IFB_LO waveform 714 indicates that the current through the primary coil 412 is acting as expected. At this point, S2, S5 Command waveform 704 and S3, S4 Command waveform 706 resume their typical operation.

Figure 8:
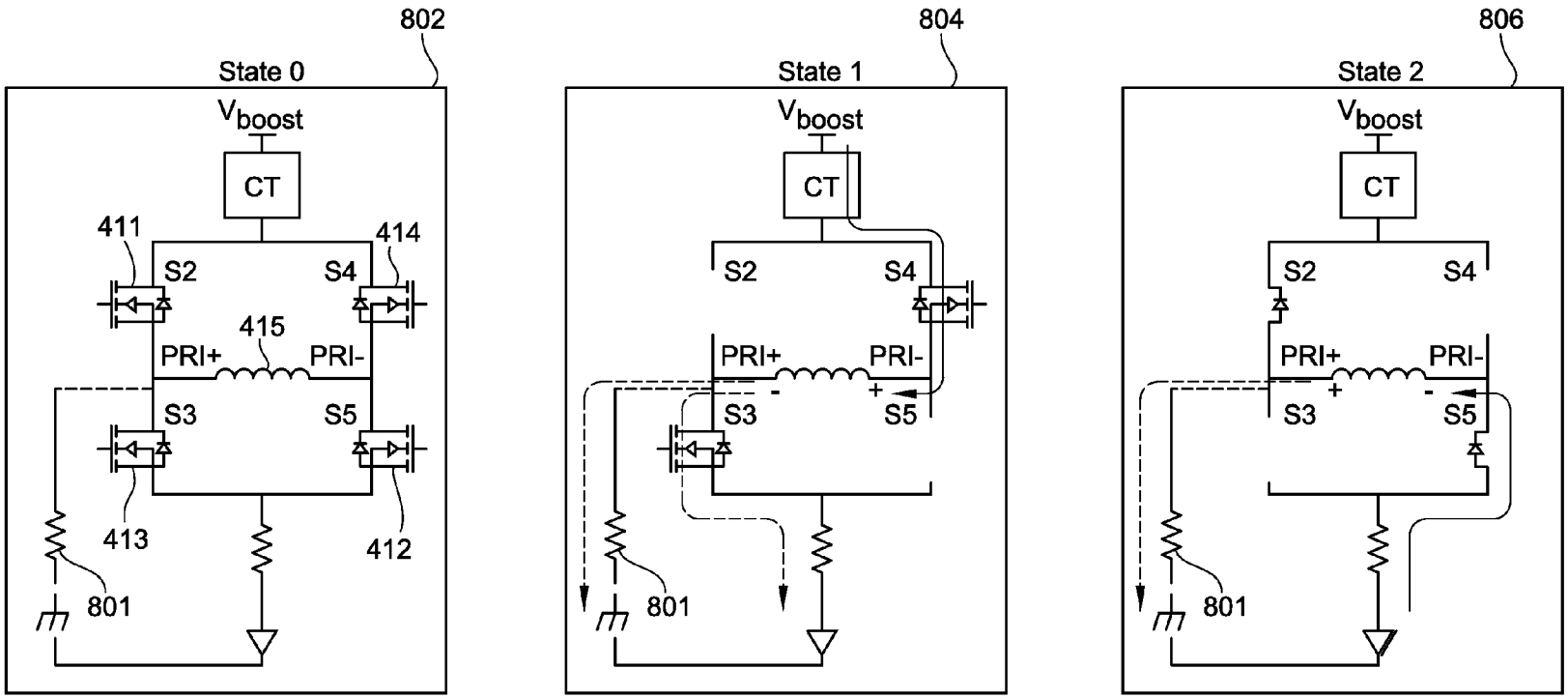
FIG. 8 shows operation of a specific aspect of the circuit in FIG. 4 when a circuit failure is present.

When a short circuit condition is actually present between terminal PRI+ (from FIG. 4) and ground, the additional operation state added to the second switching interval will result in a different current signature. FIG. 8 depicts the operation of the AC ignition system when this particular failure exists. State 0 802 shows the short circuit condition 801. After the first switch interval, depicted by state 1 804, there is negative current in the primary coil 415. When the control signal for S2 411 and S5 412 and S3 413 and S4 414 are both turned off, the short circuit condition 801 will not allow the S2 411 body diode to self commutate on, which results in current flowing through the short to ground from the S5 412 body diode, as shown by State 2 806. The alternate current path as a result of the short circuit condition will result in a much lower current change with respect to time (di/dt) through the primary coil 415, which will be detected by the absence or very late falling edge of control signals _IFB_LO and _IFB_MID.

Figure 9:
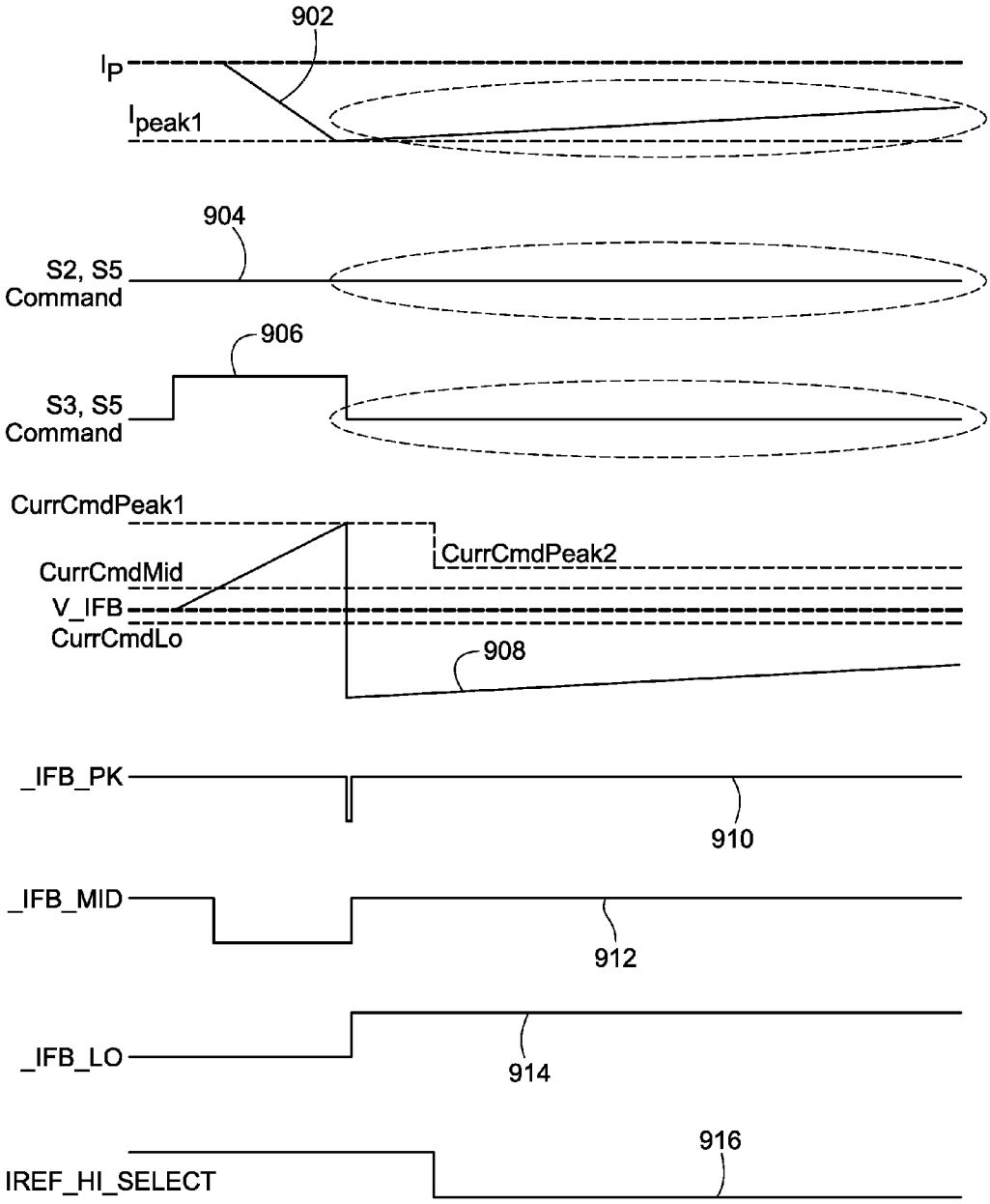
FIG. 9 contains timing diagrams showing the basic voltage and current waveforms during operation of the circuit in FIG. 4 when operated in the fashion shown in FIG. 8.

FIG. 9 shows timing diagrams depicting circuit operation while a PRI+ to ground short circuit condition 801 exists. Notice how initially when the S3, S4 Command waveform 906 is asserted current in the primary coil 415 operates as expected, as depicted by $I_P$ 902. But during state 2 806, when all switches are held in the off position the current in the primary coil 415 does not behave as it would have under normal conditions. Because the short circuit condition 801, $I_P$ significantly reduces its change with respect to time; therefore, V_IFB is unable, or at least very slow to reach the level where either comparator 405 or comparator 406 causes _IFB_MID or _IFB_LO to fall, as shown in V_IFB waveform 908. Therefore, the PRI+ to ground short circuit condition 801 will be detected when it takes too long for _IFB_MID or _IFB_LO to be triggered in FPGA 407.

This process for detecting a failure condition where PRI+ is shorted to ground does not have to take place every ignition cycle. The FPGA control circuit 400 can implement this process on an intermittent cycle.

In addition to detecting circuit failures, the FPGA control circuit 400 is capable of detecting degradation of the spark gap of a spark plug that is part of the AC ignition system. Over time, as the spark plug is used repeatedly the spark gap will slowly erode. As the spark gap grows from erosion, the voltage required to breakdown or ionize the gas between the electrodes of the spark plug increases. This increased voltage requirement correlates to an increase in the time it takes for the current in the primary coil to reach its peak value, as indicated by the _IFB_PK output of comparator 404 (from FIG. 4). The FPGA control circuit 400 can monitor the time it takes for _IFB_PK to be asserted and correlate that to a look-up table or to a previously known mathematical function.

Figure 10:
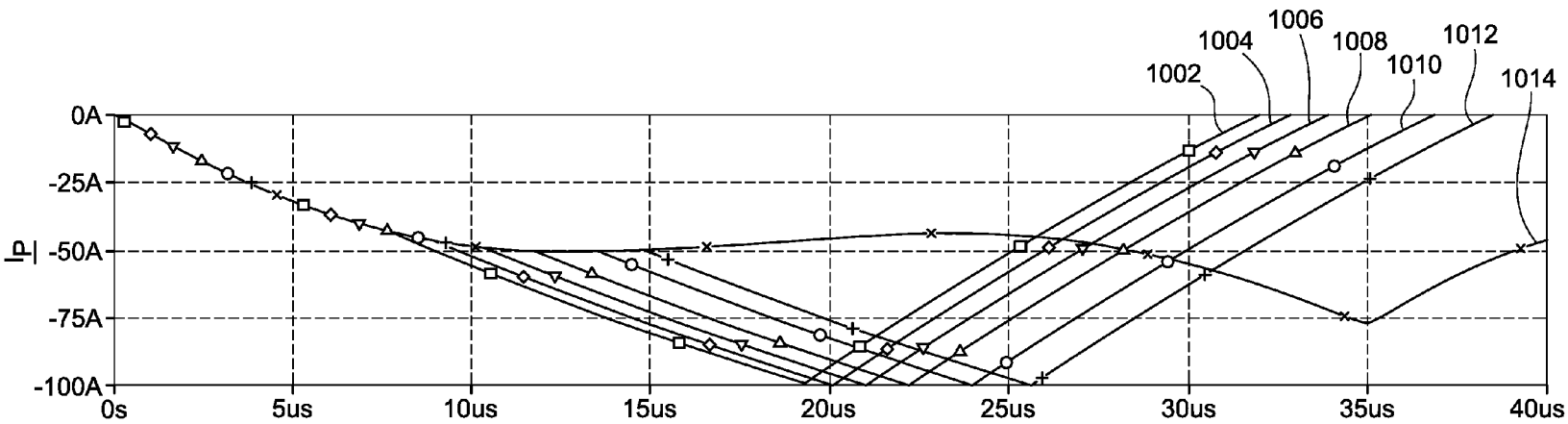
FIG. 10 shows a chart of current through a primary coil of an AC ignition system for different breakdown voltages.

FIG. 10 shows an example of the above described relationship. Specifically, FIG. 10 shows waveforms that represent the current through primary coil 415 (from FIG. 4) for different breakdown voltages (15 kV 1002, 20 kV 1004, 25 kV 1006, 30 kV 1008, 35 kV 1010, 38 kV 1012) applied across the spark gap. Also, waveform 1014 shows a case where the ignition system is not capable of breaking down the spark plug gap. FIG. 10 shows that as the breakdown voltage increases, the peak of the primary current (_IFB_PK) extends later in time. If breakdown does not occur, as shown in waveform 1014, the rate of change of the current through the primary coil 415 with respect to time is significantly less than for the situations where breakdown does occur (as shown in waveforms 1002, 1004, 1006, 1008, 1010, and 1012).

The values in FIG. 10, while indicative of system operation, are in no way meant to be limiting on system operation. Also, while the current through the primary coil 415 at which breakdown occurs is shown as −100 Amperes, a whole range of values are contemplated.

Additionally, this technique can be used to not only determine spark gap erosion but also to detect a misfire condition in the secondary side of the AC ignition system 419 (from FIG. 4). In this case, FPGA control circuit 400, by monitoring _IFB_PK, will be able to detect when it has taken too long to reach peak current in the primary coil, or be able to detect the inability to reach the peak current. The FPGA control circuit 400 will monitor the time before _IFB_PK is asserted, and when the time is greater than a corresponding time value in a look-up table the FPGA control circuit will detect a misfire.

Note that throughout the above discussion of an embodiment of the control system a "_" prefix is present for the _ISD, _IFB_PK, _IFB_MID, and _IFB_LO signals to indicate that they are active low signals. This is not meant to be limiting in that the previously mentioned signals do not have to be active low signals for the AC ignition system to function as intended. Therefore, a second embodiment exists where the _ISD, IFB_PK, IFB_MID, and IFB_LO signals are not active low.

The above mentioned control system is operable on several types of ignition systems. While all previous embodiments have described a control system for an AC ignition system, DC ignition systems are contemplated as well. For instance, the above described control system applies to PWM DC ignition systems with a DC output current and a MOSFET and diode network instead of a half bridge switching network (like in the AC system described herein).

Additionally, the control system is suitable for multiple engine types as well. For instance, on an engine having 16 spark plugs, a multiplexing 16-channel system channel AC ignition system includes 16 dedicated legs with 32 switches, and, typically, six common legs with 12 switches. When the switches are implemented as N-channel FETs, gate drives are used to translate the logic from the switch controller to a drive level sufficient to operate the switches. In one embodiment, 22 half bridge drivers are used to drive the 44 FETs in a 16-channel ignition system. Each common leg is coupled to a respective boost converter, and all 44 switches may be controlled by one PWM controller, the operation of which was previously discussed in general.

In a reciprocating engine, the cylinders are typically fired in a predetermined sequence. It is possible for there to be an overlap between adjacent firings. The possibility of such an overlap increases as the number of cylinders increase, as spark duration increases, and is more likely in engines with non-symmetric firing sequences. For example, a 16-cylinder, 4-stroke engine with a symmetric firing sequence fires an output every 45 degrees, i.e., 720 degrees/16=45 degrees. At 1800 RPM, one degree=92.59 microseconds, resulting in an output being fired once every 4.167 milliseconds. If the maximum spark duration is 2 milliseconds, for example, there will be no overlap in firings.

Figure 3:
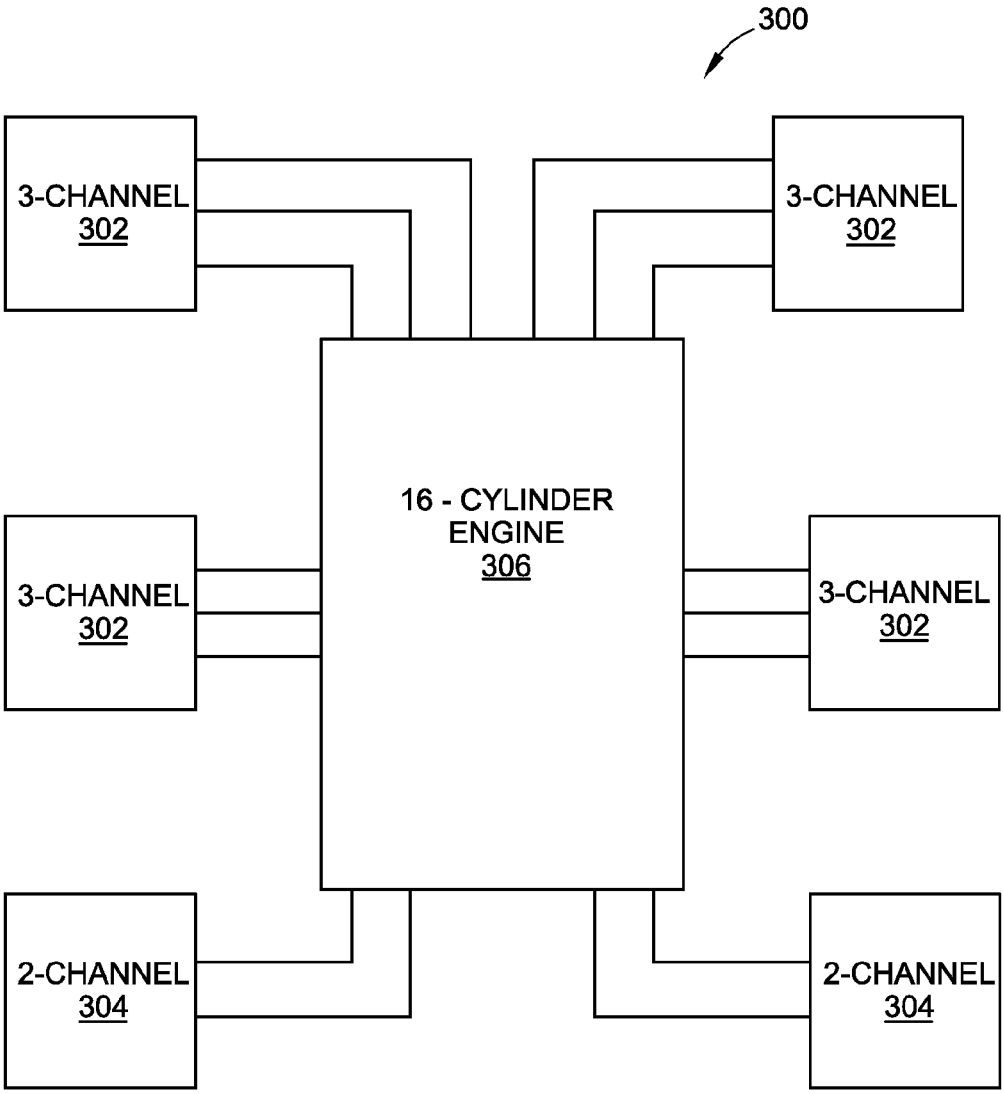
FIG. 3 is a block diagram of a 16-channel AC ignition system with multiplexing drive circuits according to an embodiment of the invention.

However, in a 16-cylinder engine with a 15-75 non-symmetric firing sequence may have such an overlap in the firing. At 1800 RPM, there is 1.39 milliseconds for those parts of the sequence with 15 degrees between firings. In this case, some overlap is possible if the spark duration is 2 milliseconds. FIG. 3 illustrates an exemplary 16-channel ignition system 300 having four 3-channel ignition system modules 302 of the type shown in FIG. 1, wherein the module includes the elements shown in phantom. Ignition system 300 further includes two 2-channel ignition system modules 304 of the type shown in FIG. 1, wherein the module does not include the elements shown in phantom. The four 3-channel ignition system modules 302 and two 2-channel ignition system modules connect to 16 spark plugs in an engine 306. A conventional non-multiplexing AC ignition system might require 64 switches (four per spark plug) to operate the 16-cylinder engine 306. However, the multiplexing feature of ignition system 300 allows the same 16-cylinder engine 306 to be operated using 44 switches. The dedicated legs of the ignition system modules 302, 304 use 32 switches, while the shared legs in those modules use 12 switches. A common switch controller 150 (shown in FIG. 1) may be used to operate all 44 switches.

This design, in which the switch controller 150 regulates precisely the level of current in the primary winding of each transformer, allows CA to be controlled independently of the SD, while maintaining the same OCV. Moreover, embodiments of the present invention manage to implement the aforementioned ignition-system features without employing costly design schemes, i.e., without center-tapped transformers, high-voltage, high-current semiconductors, resonant circuits, or high-energy-storage ignition coils.

All references, including publications, patent applications, and patents cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) is to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein.

Accordingly, this invention includes all modifications and equivalents of the subject matter recited in the claims appended here to as permitted by applicable law. Moreover, any combination of the above-described elements in all possible variations thereof is encompassed by the invention unless otherwise indicated herein or otherwise clearly contradicted by context.

What is claimed is:

1. An Alternating Current (AC) ignition device, comprising:

a switching network configured in a half bridge configuration;

an ignition transformer with a primary coil attached as the load of the switching network;

a controller configured to control the switching network;

a comparator network configured to compare AC ignition system parameters to reference parameters; where the result of the comparison indicates to the controller how to operate the switching network.

2. The AC ignition device of claim 1, wherein the system parameters and the reference parameters compared in the comparator network are voltages.

3. The AC ignition device of claim 1, wherein the reference parameters are generated by the controller.

4. The AC ignition device of claim 1, wherein the controller is configured to set a commanded value that dictates peak current through the primary coil of the ignition transformer.

5. The AC ignition device of claim 4, wherein the controller is configured to instantaneously change the commanded value.

6. The AC ignition device of claim 1, further comprising a power supply and a current sensor configured between the power supply and the switching network with the current sensor configured to provide a system parameter that correlates to current drawn from the power supply into the switching network.

7. The AC ignition device of claim 6, wherein outputs of the comparator network are inputs into the controller.

8. The AC ignition device of claim 7, wherein the controller monitors a time at which the comparator network determines that current through a primary coil of the ignition transformer has reached low and middle points as dictated by the reference parameters.

9. The AC ignition device of claim 7, wherein the controller monitors a condition where excessive current is drawn from the power supply as compared to the reference parameters.

10. The AC ignition device of claim 1, wherein a secondary coil of the ignition transformer connects to a spark plug, and wherein the controller monitors an amount of time that it takes from the moment the AC ignition device is engaged to when current through the primary coil of the ignition transformer has reached a commanded current level which is then used to correlate to when the spark plug discharges.

11. The AC ignition device of claim 1, wherein the switching network configured in a half bridge configuration comprises switches that are unidirectional with respect to voltage and bidirectional with respect to current.

12. A method for controlling an ignition system, comprising the steps of:

measuring system parameters of an initial ignition cycle;

comparing the system parameters with reference parameters of the ignition system;

changing the operational state of a switching network if the comparison of system parameters to reference parameters shows a peak current has been reached in a load of the switching network; and wherein the step of changing the operational state of the switching network triggers a subsequent current cycle in a load of the switching network.

13. The method of claim 12, further comprising the step of changing the reference parameter that sets a commanded value for peak current in the load of the switching network.

14. The method of claim 12, wherein the reference parameters are ideal voltages corresponding to values for low current in the load of the switching network, a middle current between ideal low current and ideal peak current in the load of the switching network, ideal peak current in the load of the switching network, and an ideal maximum value of current supplied to the switching network; wherein the system parameters are a measured voltage that correspond to current in the load of the switching network and a measured voltage that corresponds to current supplied to the switching network.

15. The method of claim 14, wherein the step of comparing compares the voltage corresponding to ideal peak current in the ignition system to the measured voltage that corresponds to current in the load of the switching network.

16. The method of claim 14, further comprising the step of diagnosing failures in the ignition system.

17. The method of claim 16, wherein the step of diagnosing failures comprises the step of indicating that during the comparing step the measured voltage that corresponds to current supplied to the switching network is greater than the ideal maximum value of current supplied to the switching network.

18. The method of claim 16, wherein the step of comparing further comprises measuring a time it takes from a start of the ignition cycle for the measured voltage that corresponds to current in the load of the switching network to rise from at least one of the ideal low voltage to the ideal middle voltage for the load of the switching network, from the ideal low voltage to the ideal peak voltage for the load of the switching network, or from the ideal middle voltage to the ideal peak voltage for the load of the switching network, and wherein the step of diagnosing comprises the step of indicating that a measured time from the step of measuring happened faster than expected, longer than expected, and/or never happened.

19. The method of claim 14, wherein the load of the switching network is a primary coil of an ignition transformer with a secondary coil attached to a spark plug; wherein the step of comparing further comprises the step of measuring the time it takes from the start of the ignition cycle for the voltage that corresponds to current in the load of the switching network to reach the ideal peak current in the load of the switching network, and storing the measured time.

20. The method of claim 19, further comprising the step of determining the level of erosion of a spark gap of the spark plug.

21. The method of claim 20, wherein the step of determining the level of erosion is done by correlating a measured time from the initial ignition event to a breakdown of the spark gap of the spark plug to reference values for an amount of time it takes to breakdown a representative spark gap of a representative spark plug at various levels of erosion for the representative spark gap.

22. The method of claim 21, wherein the references values are contained in a look-up table.

23. The method of claim 19, wherein the measured time is compared to a predefined period of time, and if the measured time exceeds the predefined period of time a misfire condition has occurred.

24. The method of claim 12, wherein the switching network is a half bridge switching network.

25. The method of claim 12, wherein the ignition system is an Alternating Current (AC) ignition system.

26. The method of claim 25, wherein the switching network of the AC ignition system is a half bridge switching network

27. The method of claim 12, wherein the ignition system is a Direct Current (DC) ignition system.

28. The method of claim 27, wherein the DC ignition system output current is a DC value and the switching network is a MOSFET and diode network.

* * * * *